US010773923B2

(12) United States Patent
Puranen et al.

(10) Patent No.: US 10,773,923 B2
(45) Date of Patent: Sep. 15, 2020

(54) METHOD FOR AVOIDING UNWANTED SAFETY GEAR TRIPPING IN AN ELEVATOR SYSTEM, CONTROLLER ADAPTED TO PERFORM SUCH A METHOD, GOVERNOR BRAKE AND ELEVATOR SYSTEM EACH HAVING SUCH A CONTROLLER

(71) Applicant: KONE Corporation, Helsinki (FI)

(72) Inventors: Mikko Puranen, Helsinki (FI); Riku Lampinen, Helsinki (FI); Jarkko Saloranta, Helsinki (FI); Antti I Mäki, Helsinki (FI); Jukka Turpeinen, Helsinki (FI); Samuli Mäntynen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 441 days.

(21) Appl. No.: 15/692,988

(22) Filed: Aug. 31, 2017

(65) Prior Publication Data

US 2018/0111789 A1 Apr. 26, 2018

(30) Foreign Application Priority Data

Oct. 14, 2016 (EP) ..... 16193977

(51) Int. Cl.
*B66B 1/32* (2006.01)
*B66B 5/18* (2006.01)
(Continued)

(52) U.S. Cl.
CPC ..... *B66B 1/32* (2013.01); *B66B 1/36* (2013.01); *B66B 5/044* (2013.01); *B66B 5/18* (2013.01); *B66B 5/16* (2013.01)

(58) Field of Classification Search
CPC ... D07B 2501/2007; B66B 5/18; B66B 5/044; B66B 1/32; B66B 5/04; B66B 5/02;
(Continued)

(56) References Cited

U.S. PATENT DOCUMENTS 5,630,483 A * 5/1997 Karner ..... B66B 5/048 187/350
2003/0183457 A1* 10/2003 Maury ..... B66B 5/04 187/250
(Continued)

FOREIGN PATENT DOCUMENTS

WO WO 03/091142 A1 11/2003

OTHER PUBLICATIONS

European Search Report for EP 16 19 3977 dated Apr. 6, 2017.

*Primary Examiner* — Marlon T Fletcher
(74) *Attorney, Agent, or Firm* — Birch, Stewart, Kolasch & Birch, LLP

(57) ABSTRACT

In the technical field of elevator systems, so as to provide a measure for preventing an overspeed governor rope inertia from unwantedly engaging a safety gear in an overspeed governor system, which has a governor rope connected to a moving mass of the elevator system, a machinery brake for decelerating the moving mass so as to perform a quick stop of the moving mass, a safety gear mounted to the moving mass, a synchronization linkage for tripping the safety gear and a synchronization linkage blocking device for blocking the synchronization linkage and/or a governor brake for braking the governor rope, it is determined whether a quick stop of the moving mass is performed, and the governor brake or the synchronization linkage blocking device is activated when the quick stop of the moving mass is performed.

20 Claims, 15 Drawing Sheets

(51) Int. Cl.
*B66B 5/04* (2006.01)
*B66B 1/36* (2006.01)
*B66B 5/16* (2006.01)

(58) Field of Classification Search
CPC ..... B66B 19/02; B66B 5/16; B66B 5/028; B66B 5/048; B66B 1/3492; A61G 7/1015
See application file for complete search history.

(56) References Cited

U.S. PATENT DOCUMENTS

| | | | | |
|---|---|---|---|---|
| 2009/0314586 | A1* | 12/2009 | Okada | B66B 5/044 187/287 |
| 2011/0266097 | A1* | 11/2011 | Valjus | B66B 7/062 187/254 |
| 2012/0103732 | A1* | 5/2012 | Kwon | B66B 5/044 187/305 |
| 2018/0111789 | A1* | 4/2018 | Puranen | B66B 1/32 |
| 2018/0186603 | A1* | 7/2018 | Virta | B66B 5/044 |
| 2018/0297814 | A1* | 10/2018 | Shiraishi | B66B 5/22 |

* cited by examiner

METHOD FOR AVOIDING UNWANTED SAFETY GEAR TRIPPING IN AN ELEVATOR SYSTEM, CONTROLLER ADAPTED TO PERFORM SUCH A METHOD, GOVERNOR BRAKE AND ELEVATOR SYSTEM EACH HAVING SUCH A CONTROLLER

FIELD OF THE INVENTION

The present invention relates to a method for avoiding unwanted safety gear tripping in an elevator system, a controller adapted to perform such a method, a governor brake and an elevator system each having such a controller.

RELATED BACKGROUND ART

The following description of background art and examples may include insights, discoveries, understandings or disclosures, or associations, together with disclosures not known to the relevant prior art, to at least some examples of embodiments of the present invention but provided by the invention. Some of such contributions of the invention may be specifically pointed out below, whereas other of such contributions of the invention will be apparent from the related context.

FIG. 15 shows an elevator system 101 according to the related background art. This elevator system 101 comprises an elevator car 106 which is connected to a counterweight 107 via suspension ropes 113 which go over a traction wheel 112 driven by a hoisting machine (not shown). The elevator car 106 and the counterweight 107 are both guided vertically by respective guide rails inside a shaft (both not shown). In the following, the elevator car 106 and the counterweight 107 are referred to as the moving mass.

The elevator system 101 further comprises a safety circuit having a plurality of normally closed safety switches for monitoring the safety status of the elevator in normal operation. If the safety of the elevator is somehow compromised, at least one of the safety switches is opened, the hoisting machine is de-energised and machinery brakes 116 are engaged so as to decelerate the moving mass for quick stop. These safety switches can be opened in the event of opening an emergency exit hatch of the elevator car 106, arrival at an extreme limit of permitting movement in the shaft, opening of a door of the elevator car 106 and so on.

The elevator system 101 further comprises an overspeed governor system 102 for the elevator car 106, which has a governor rope loop 103 directed up from the elevator car 106, over an overspeed governor pulley 108, then down and under a tension weight pulley 109 connected to a tension weight 110 and then up again to the elevator car 106 to be connected to a synchronization linkage 114 for tripping an elevator car safety gear 104. A corresponding overspeed governor system 152 can be attached to the counterweight 107. The elements of the overspeed governor system 152 are provided with reference signs which are obtained by adding the value 50 to the values of the reference signs of the overspeed governor system 102 for the elevator car 106.

The synchronization linkage 114 has synchronization levers which make the safety gear 104 of the moving mass to engage the guide rails of the moving mass when at least a predetermined force is applied to the synchronization linkage 114 by the governor rope 103. This predetermined force is acting against spring forces of synchronization lever springs such that the synchronization lever engages the safety gear when the force applied by the governor rope 103 exceeds the synchronization lever spring force.

The overspeed governor system 102 supervises the speed of the moving mass, and, if this speed exceeds a predetermined tripping speed which is above a rated speed of the elevator, it opens a further safety switch of the above explained safety chain to activate the machinery quick stop operation described above and, simultaneously, decelerates the governor rope 103. This deceleration of the governor rope 103 acts against the spring forces of synchronization lever springs such that the synchronization lever engages the safety gear 104, bringing the elevator car 106 into an emergency stop.

To summarise, a quick stop operation of the machinery is initiated whenever the elevator safety circuit indicates a compromised safety status of the elevator.

Additionally, if the compromised safety status is a result of an overspeed condition of the moving mass, detected by overspeed governor, an emergency stop operation is activated by engaging the safety gear of the moving mass.

However, in high rise elevators, the elevator travel and speed increase such that the inertia of the governor rope 103 increases substantially. This brings a new challenge during elevator quick stops carried out by the hoisting machine brakes 116. Namely, when the governor rope 103 having the increased length decelerate during the above explained quick stop, a large force is applied to the synchronization linkage 114, because the inertia of the governor rope 103 is large. As a result, the decelerating governor rope 103 is capable of producing forces to the synchronization linkage 114 which exceed the needed force to engage the safety gear 104 when the moving mass is decelerated. In other words, the safety gear 104 might be unwantedly engaged or tripped during quick stop although the speed of the moving mass has not exceeded the predetermined tripping speed for engaging the safety gear 104.

One solution for preventing unwanted safety gear tripping is to increase the synchronization lever spring force. However, this has an effect on the design of the overspeed governor since EN-81 codes require that the pull through force of the governor rope is twice as big as the force needed to engage the safety gear via the synchronization linkage. Stronger synchronization leads to bigger overspeed governor pull-through forces and, consequently a stronger and, thus, heavier overspeed governor rope due to required safety factor. It is evident that this will finally lead to elevator systems in which there is no more feasible design window for overspeed governor and safety gear system.

Hence, it is the object of the present invention to provide a measure for preventing the overspeed governor rope inertia from unwantedly engaging the safety gear.

BRIEF DESCRIPTION OF THE INVENTION

According to the present invention, the above object is solved with a method for avoiding unwanted safety gear tripping in an overspeed governor system of an elevator system, the overspeed governor system having a governor rope connected to a moving mass of the elevator system, a machinery brake for decelerating the moving mass so as to perform a quick stop of the moving mass, a safety gear mounted to the moving mass, a synchronization linkage for tripping the safety gear and a synchronization linkage blocking device for blocking the synchronization linkage and/or a governor brake for braking the governor rope, the method comprising the step of determining whether a quick stop of the moving mass is performed, and activating the governor brake and/or the synchronization linkage blocking device when the quick stop of the moving mass is performed.

According to this method, when a quick stop of the moving mass is performed, and thus the deceleration of the governor rope exceeds an allowable deceleration, the governor brake is activated according to a first alternative. By activating the governor brake, the kinetic energy of the governor rope is dissipated such that the force applied to the synchronization linkage is reduced. As a result, the safety gear is not unwantedly tripped during deceleration of the elevator car. According to a second alternative, the synchronization linkage blocking device is activated when the quick stop of the moving mass is performed. As a result, although a large force might be applied to the synchronization linkage, the synchronization levers are prevented from movement such that the safety gear is not unwantedly tripped during deceleration of the elevator car.

According to a preferable embodiment, the elevator system comprises a safety circuit configured to indicate that the safety of the elevator system is jeopardized if a safety circuit switch of the safety circuit is open, wherein the method further comprises determining whether the safety circuit indicates jeopardized safety, and concluding that the quick stop of the moving mass is performed if said jeopardized safety indication is present. According to this embodiment, the already existing safety circuit can be used for concluding about whether a quick stop is performed without the need of providing a separate means for determining whether the quick stop is performed. In other words, if the safety circuit is open, the elevator system carries out a quick stop which results in that the deceleration of the elevator car exceeds the allowable deceleration.

According to a further preferable embodiment, the elevator system comprises a controller for controlling stopping of the moving mass at a terminal floor and a normal terminal slowdown device configured to output a normal terminal slowdown signal if stopping of the moving mass at the terminal floor by control of the controller is jeopardized, wherein the method further comprises determining whether the normal terminal slowdown signal is output, and concluding that the quick stop is performed if the normal terminal slowdown signal is output. According to this embodiment, the already existing normal terminal slowdown device (NTS device) can be used for concluding about whether the quick stop is performed without the need of providing a separate means for determining whether the quick stop is performed. In other words, if the normal terminal slowdown signal, i.e. if the NTS device is activated, the elevator system carries out a quick stop which results in that the deceleration of the elevator car exceeds the predetermined deceleration limit.

According to a further preferable embodiment, the elevator system comprises an elevator car and a counterweight each acting as a moving mass, wherein one overspeed governor system is provided for the elevator car and another overspeed governor system is provided for the counterweight, further comprising determining whether the elevator car moves up or down, and if the elevator car moves up, the governor brake and/or the synchronization linkage blocking device of the overspeed governor system for the elevator car is activated, and if the elevator car moves down, the governor brake and/or the synchronization linkage blocking device of the overspeed governor system for the counterweight is activated. Here, in case the elevator car moves up, there is a risk of unwanted safety gear tripping at the elevator car. By contrast, in case the counterweight moves up, i.e. the elevator car moves down, there is a risk of unwanted safety gear tripping at the counterweight. Hence, the respective governor brake and/or the respective synchronization linkage blocking device is activated thus avoiding to unnecessarily activate the governor brake and/or block the synchronization linkage where there is no risk of unwanted safety gear tripping. As a result, the service life of the governor brake and that of a device for blocking the synchronization linkage can be made longer.

The object is further solved with an unwanted safety gear tripping avoiding controller for avoiding unwanted safety gear tripping in an elevator system, the unwanted safety gear tripping avoiding controller being adapted to perform the above explained method steps. With this controller, the same advantages as those described above can be obtained.

The object is further solved with a governor brake for braking a governor rope so as to avoiding unwanted safety gear tripping in an elevator system, wherein the elevator system comprises an overspeed governor system having at least a governor rope connected to a moving mass of the elevator system, a machinery brake for decelerating the moving mass so as to perform a quick stop, and a safety gear mounted to the moving mass, the governor brake further comprising the above explained unwanted safety gear tripping avoiding controller. By means of this governor brake, the invention can easily be implemented into existing elevator systems and overspeed governor systems. Since, the governor brake already comprises the unwanted safety gear tripping avoiding controller, it is not necessary for the controllers of the elevator systems and overspeed governor systems to be replaced because the control can entirely be done by the unwanted safety gear tripping avoiding controller of the governor brake.

According to a further preferable embodiment, the unwanted safety gear tripping avoiding controller of the governor brake is adapted to monitor the safety circuit and/or the normal terminal slowdown device of the elevator system so as to conclude about that the quick stop of the moving mass is performed. This allows the governor brake to use information of the safety circuit and/or the normal terminal slowdown device for concluding about whether the quick stop of the moving mass is performed without the need of a separate device dedicated to this conclusion.

According to a further preferable embodiment, the governor brake further comprises an elevator movement detecting device for detecting an elevator deceleration of the governor rope, wherein the unwanted safety gear tripping avoiding controller is adapted to monitor the elevator movement detecting device so as to conclude about whether the quick stop of the moving mass is performed. This allows to provide a fully independent system without the need of providing modifications or new features for the elevator control system.

According to a further preferable embodiment, the elevator movement detecting device is a speed sensor which is adapted to measure the speed of the governor rope, or an accelerometer or a gyroscope adapted to measure the deceleration of the governor rope, directly or indirectly.

Furthermore, the object is solved with an elevator system comprising an overspeed governor system having at least a governor rope connected to a moving mass of the elevator system, a machinery brake for decelerating the moving mass so as to perform a quick stop of the moving mass, a safety gear mounted to the moving mass, a synchronization linkage for tripping the safety gear, a synchronization linkage blocking device for blocking the synchronization linkage and/or a governor brake for braking the governor rope, and an unwanted safety gear tripping avoiding controller having the above explained features.

According to a further preferable embodiment the elevator system further comprises an elevator car controller and the unwanted safety gear tripping avoiding controller is implemented in the elevator controller. This allows to implement the invention into the existing elevator controller. When the existing elevator car controller uses a low latency bus such as LAN or CAN, the reaction time for activating the governor brake or blocking the synchronization linkage is not affected.

According to a further preferable embodiment, the governor system further comprises an OSG brake controller (overspeed governor brake controller) and the unwanted safety gear tripping avoiding controller is implemented in the OSG brake controller.

According to a further preferable embodiment, the elevator system comprises an elevator car and a counterweight each acting as a moving mass, wherein one overspeed governor system is provided for the elevator car and another overspeed governor system is provided for the counterweight, wherein the elevator system further comprises an elevator controller and the overspeed governor system further comprises an overspeed governor system controller both constituting the unwanted safety gear tripping avoiding controller, wherein the elevator controller is adapted to determine whether the elevator car moves up or down and to determine whether the moving speed of the elevator car exceeds a predetermined speed limit, and the elevator car controller is adapted to send an activation signal and a moving direction signal to the OSG brake controller if the moving speed of the elevator car exceeds the predetermined speed limit, wherein the OSG brake controller is adapted to, upon receipt of the activation signal and the moving direction signal, determine whether the quick stop is performed, and when the quick stop is performed, to activate the governor brake and/or the synchronization linkage blocking device of the overspeed governor system for the elevator car, if the moving direction signal indicates that the elevator car moves up, and to activate the governor brake and/or the synchronization linkage blocking device of the overspeed governor system for the counterweight if the moving direction signal indicates that the elevator car moves down. According to this embodiment, the elevator controller determines whether the moving speed of the elevator car is above a predetermined speed limit above which there is a risk of unwanted gear tripping due to the elevator car being decelerated. Thus, when the moving speed of the elevator car is below this speed limit, there is no risk of unwanted safety gear tripping such that there is no need of activating the overspeed governor system controller. If, however, the moving speed of the elevator car is above the speed limit, the overspeed governor system controller is activated and further receives the moving direction signal. On the basis of this information, the overspeed governor system controller can then activate the governor brake and/or the synchronization linkage blocking device of the correct moving mass, namely that of the elevator car in case the elevator car is moving up, and that of the counterweight in case the elevator car is moving down. This allows to avoid unnecessary activation of the governor brake or blocking of the synchronization linkage of the other, the incorrect moving mass. As a result, the service life of the governor brake of the blocking device can be increased.

Also according to this embodiment, the determination whether the quick stop is performed can be made on the basis of whether the safety circuit is open or whether the normal transportation slowdown device is activated.

According to a further embodiment, the speed governor system further comprises an overspeed governor pulley and a tension weight pulley, and the governor brake is a brake device acting on the overspeed governor pulley, a brake device acting on the governor rope or a brake device acting on tension weight pulley.

Furthermore, the object is solved with a synchronization linkage blocking device for blocking a synchronization linkage so as to avoid unwanted safety gear tripping in an elevator system, wherein the elevator system comprises an overspeed governor system having at least a governor rope connected to a moving mass of the elevator system via the synchronization linkage, a machinery brake for decelerating the moving mass so as to perform a quick stop of the moving mass, and a safety gear mounted to the moving mass, the synchronization linkage blocking device further comprising the above described unwanted safety gear tripping avoiding controller.

According to a further preferable embodiment, the unwanted safety gear tripping avoiding controller of the synchronization linkage blocking device is adapted to monitor the safety circuit and/or the normal terminal slowdown device of the elevator system so as to conclude about whether the deceleration of the elevator car exceeds the predetermined deceleration limit. This allows the synchronization linkage blocking device to use information of the safety circuit and/or the normal terminal slowdown device for concluding about whether the deceleration of the elevator car exceeds the predetermined deceleration limit without the needs of a separate device dedicated to this conclusion.

According to a further preferable embodiment, the synchronization linkage blocking device further comprises an elevator movement detecting device for detecting an elevator deceleration of the governor rope. This allows to provide a fully independent system without the need of providing modifications or new features for the elevator control system.

BRIEF DESCRIPTION OF THE DRAWINGS

These and other objects, features, details and advantages will become more fully apparent from the following detailed description of embodiments of the present invention which is to be taken in conjunction with the appended drawings, in which.

DETAILED DESCRIPTION OF EMBODIMENTS

In the following, description will be made to embodiments of the present invention. It is to be understood, however, that the description is given by way of example only, and that the described embodiments are by no means to be understood as limiting the present invention thereto.

In particular, different exemplifying embodiments will be described using, as an example of an elevator system to which the embodiments may be applied, an elevator system as depicted and explained in connection with FIGS. 1 to 3.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments. Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Figure 1:
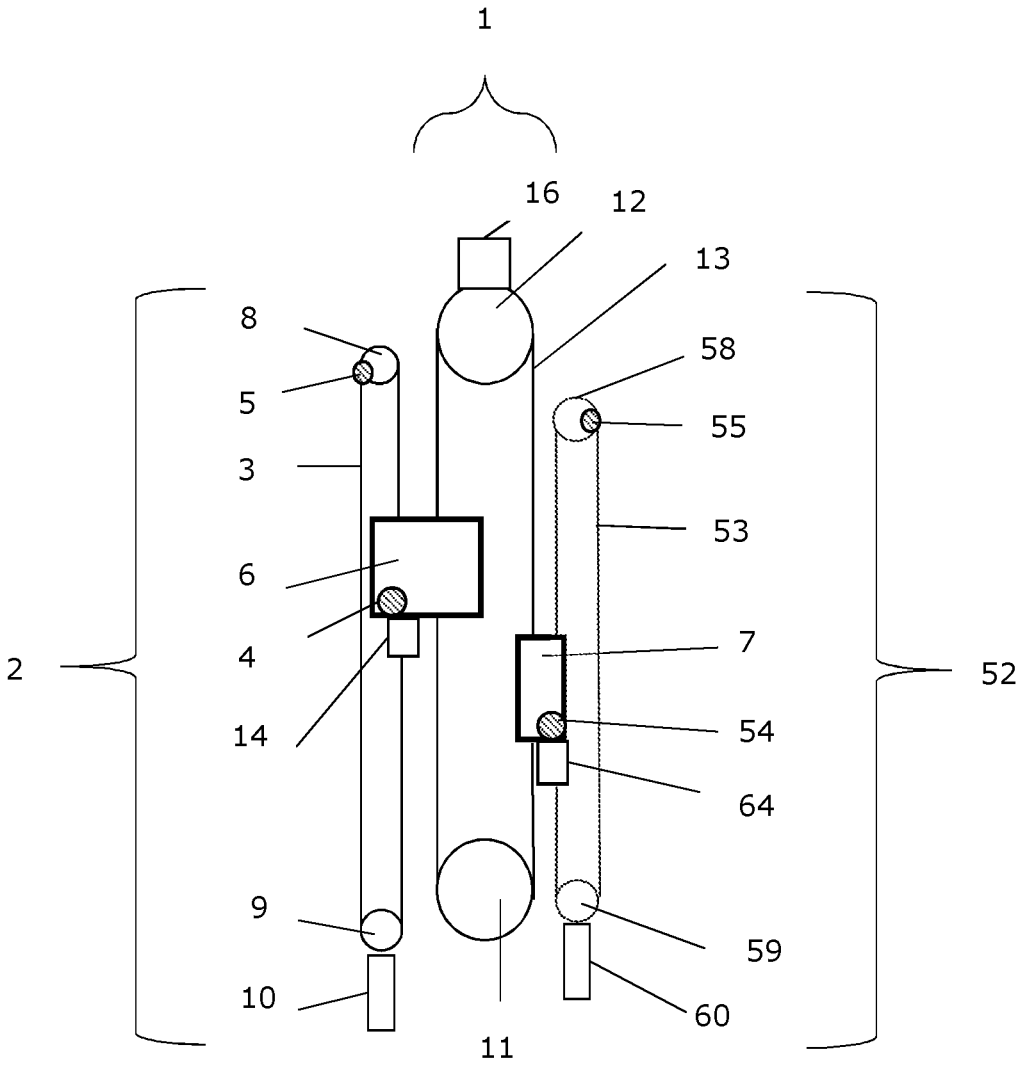
FIG. 1 shows an elevator system according to a first embodiment of the present invention.

FIG. 1 shows an elevator system 1 having an elevator car 6 and a counterweight 7, which are both acting a moving mass and are connected to each other by suspension ropes 13. The suspension ropes 13 are going around a traction wheel 12 which is driven by a hoisting machine (not shown). Because of the heavy mass hanging on both ends of the suspension ropes 13, the suspension ropes 13 do not slide on the traction wheel 12. When the traction wheel 12 is driven by the hoisting machine and rotates, the elevator car 6 and the counterweight 7 move. The elevator car 6 and the counterweight 7 are guided by guide rails (not shown) which are mounted to the walls of the shaft (not shown) in which the elevator system 1 is provided.

FIG. 1 further shows an overspeed governor (OSG) system 2 for the elevator car 6, which comprises a governor rope 3 both ends of which are connected to the elevator car 6 (the moving mass). The governor rope 3 goes around a governor pulley 8 on the top side of the elevator system and goes around a tension weight pulley 9 connected to a tension weight 10 on the bottom side of the elevator system. The governor rope 3 is connected to the elevator car 6 via a synchronization linkage 14 having synchronization levers for tripping a safety gear 4 against both guide rails of the elevator car 6.

FIG. 1 further shows an overspeed governor (OSG) system 52 for the counterweight 7, which comprises a governor rope 53 both ends of which are connected to the counterweight 7 (the moving mass). The governor rope 53 goes around a governor pulley 58 on the top side of the elevator system and goes around a tension weight pulley 59 connected to a tension weight 60 on the bottom side of the elevator system. The governor rope 53 is connected to the counterweight 7 via a synchronization linkage 64 having synchronization levers for tripping a safety gear 54 against both guide rails of the counterweight 7.

Furthermore, FIG. 1 shows that the OSG systems 2, 52 are provided with a governor brake 5, 55 which is configured to reduce the force applied to the synchronization linkage 14 by the governor rope 3, 53 when the governor brake 5, 55 is operated. In more detail, the governor brake 5, 55 is configured to dissipate the kinetic energy of the governor rope 3, 53. FIG. 1 schematically shows that the governor brake 5, 55 acts on the governor pulley 8, 58. However, according to FIG. 2, the governor brake 5', 55' can act directly on the governor rope 3, and according to FIG. 3, the governor brake 5", 55" can act on the tension weight pulley 9, 59.

Figure 4A:
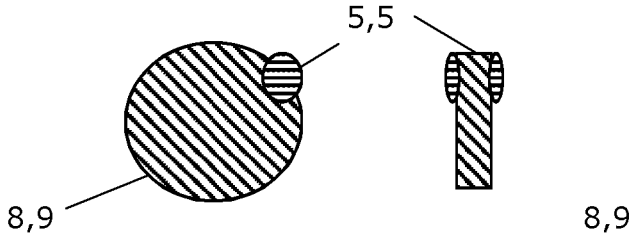
FIGS. 4A to 4D show examples of the governor brakes shown in FIGS. 1 to 3.
Figure 4B:
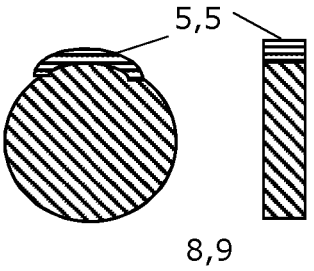
Figure 4C:
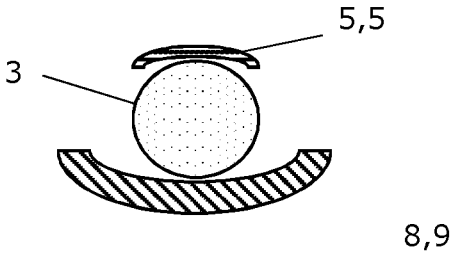

FIGS. 4A to 4C show alternative embodiments of the governor brakes 5, 5' and 5" which apply also to the governor brakes 55, 55' and 55". According to FIG. 4A, in the governor brakes 5 and 5", which act on the governor pulley 8 or the tension weight pulley 9, the brake force can act on the pulley side. According to FIG. 4B, in the governor brakes 5 and 5", which act on the governor pulley 8 or the tension weight pulley 9, the brake force can act on the pulley groove edge. According to FIG. 4C, in the governor brakes 5 and 5", which act on the governor pulley 8 or the tension weight pulley 9, the brake force can act on the governor rope 3 on the groove. According to the approaches of FIGS. 4A and 4B, the rope friction in the groove is the dimensioning factor on the brake force. According to the approach of FIG. 4C, the rope robustness against damage is the dimensioning factor.

Figure 2:
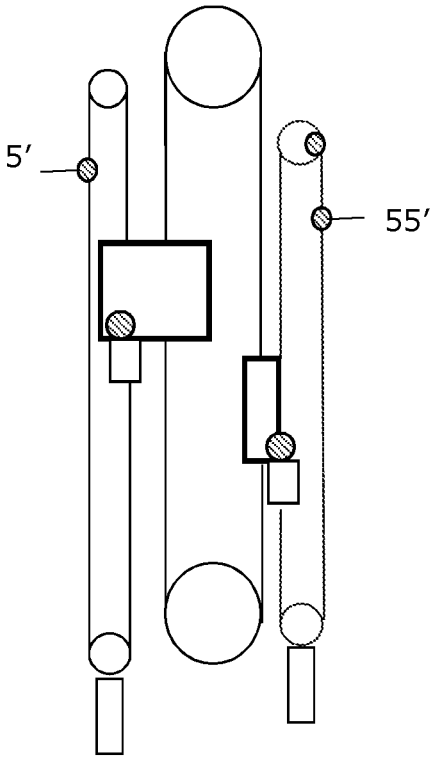
FIG. 2 shows a modification of the elevator system shown in FIG. 1.
Figure 3:
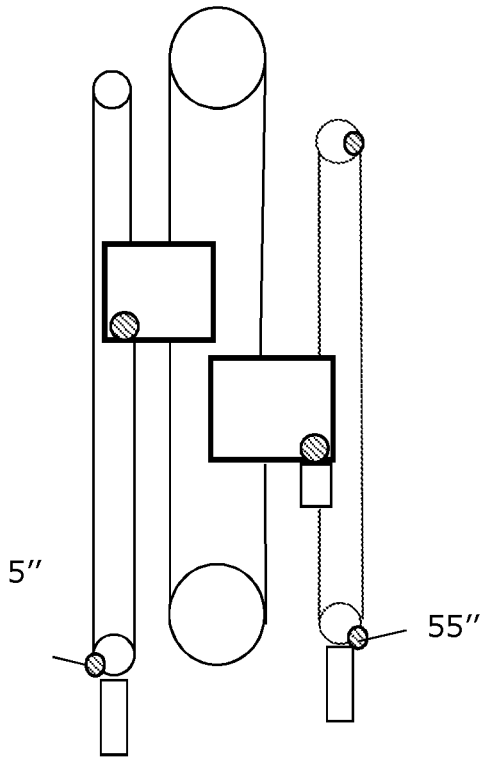
FIG. 3 shows a further modification of the elevator system shown in FIG. 1.
Figure 4D:
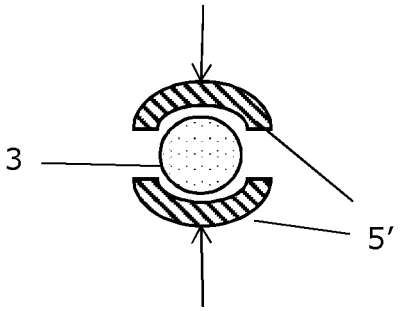

FIG. 4D shows details of the governor brake 5' of the elevator system shown in FIG. 2. This brake device is a standalone device acting on the governor rope 3, similar mechanism like OSG rope clamp acting on the rope but with smaller force than OSG tripping force.

Figure 4E:
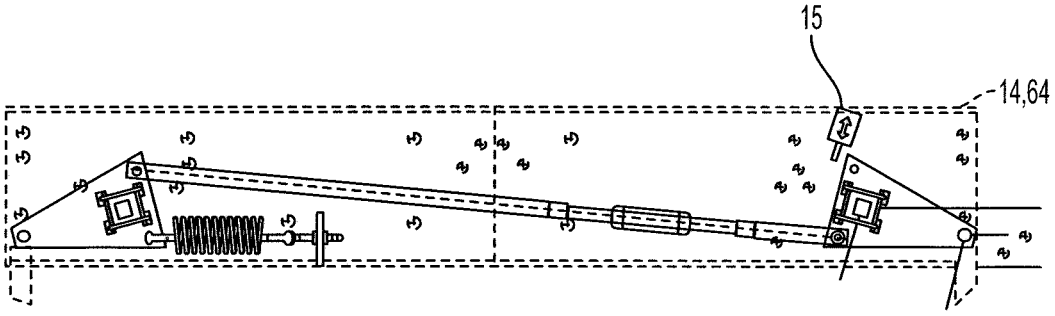
FIG. 4E shows a synchronization linkage of the elevator system shown in FIGS. 1 to 3.

FIG. 4E shows the synchronization linkage 14, 64 in more detail. According to one embodiment, the synchronization linkage 14, 64 is provided with a synchronization linkage blocking device 15 which is adapted to block the operation of the synchronization linkage 14, 64.

Thus, by means of one of the governor brakes 5, 5' 5" and/or by means of the synchronization blocking device 15, unwanted tripping of the safety gear 4, 54 can be prevented. Hence, if there is a situation which requires to prevent unwanted tripping of the safety gear 4, 54, either the governor brakes 5, 5', 5" or the synchronization blocking device 15 can be operated. Alternatively, both of them can be operated simultaneously.

In the following, the control schemes according to a first embodiment are described with reference to FIGS. 5, 6 and 7.

Figure 5:
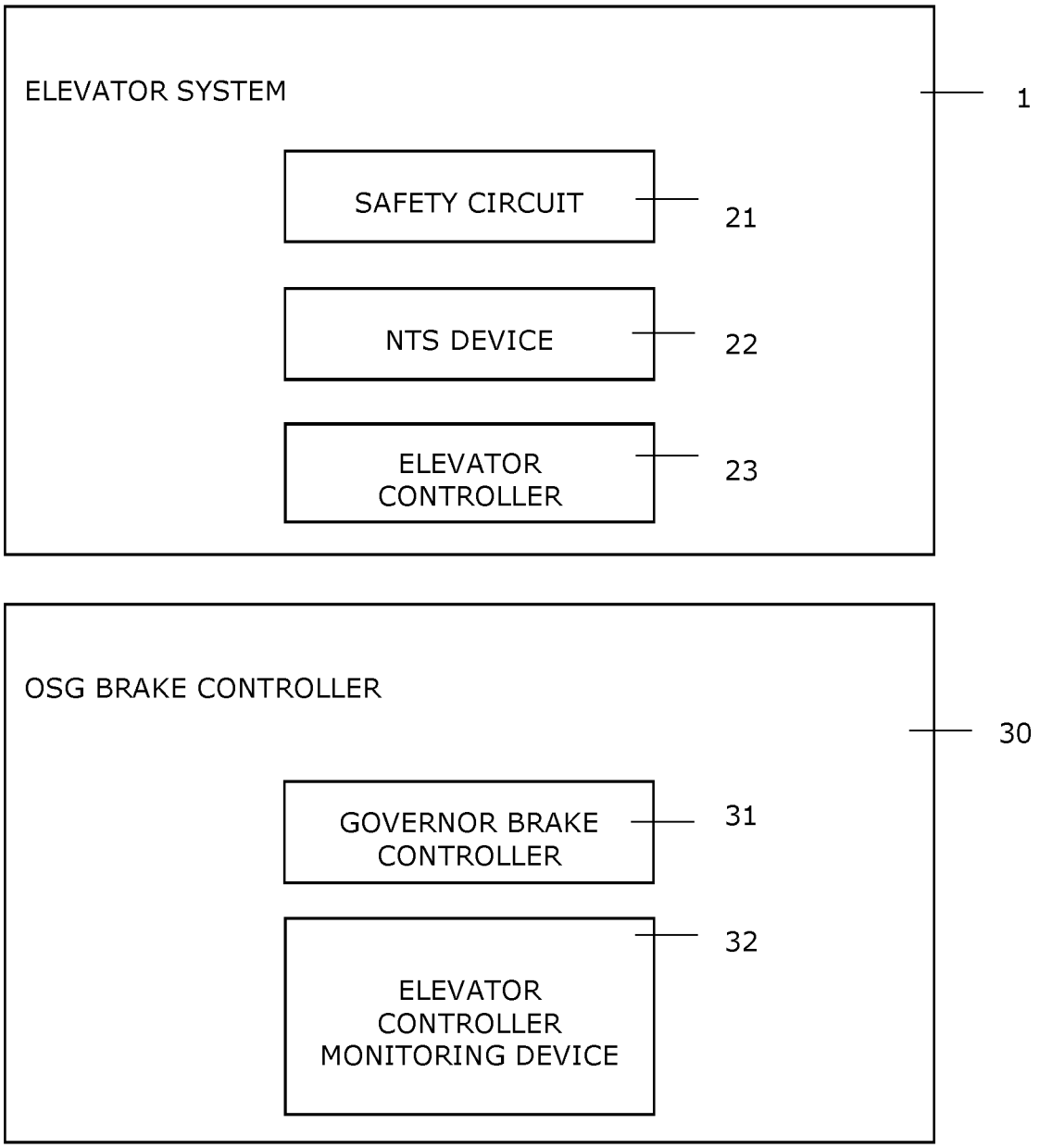
FIG. 5 shows a controller scheme of the elevator system and the OSG system according to the first embodiment.

FIG. 5 shows a control scheme of the elevator system 1 according to the first embodiment. Here, in addition to the above described constituents, the elevator system 1 comprises a safety circuit 21, and a NTS (normal terminal slowdown) device 22 as well as an elevator controller 23.

The safety circuit 21 comprises a plurality of safety switches as the one explained for the background art. The safety switches are normally closed and are opened during a functional nonconformance of the elevator system 1. When one of the safety switches is open, the safety circuit 21 indicates a functional nonconformance of the elevator system 1, meaning that the safety of the elevator system is jeopardized. The elevator controller 23 receives this indication from the safety circuit and activates hoisting machine brake 16 of the elevator system 1 so as to perform a quick stop of the elevator car 6.

Furthermore, the elevator controller 23 is adapted to control stopping of the elevator car 6 at a terminal floor which is the uppermost or the lowermost floor. However, if the elevator car 6 fails to stop at the terminal floor, the normal terminal slowdown device 22 outputs a normal terminal slowdown signal. The normal terminal slowdown signal is sent to the elevator controller 23 which cuts the power from hoisting machinery and activates the hoisting machine brake 16 of the elevator system 1 so as to perform a quick stop of the elevator car 6.

Furthermore, the control scheme comprises an OSG brake controller 30 having a governor brake controller 31 and an elevator controller monitoring device 32. The governor brake controller 31 is configured to operate the governor brake 5, 5' or 5". The governor brake controller 31 can be replaced or complemented by a synchronization blocking device controller which is configured to operate the synchronization blocking device 15.

Figure 6:
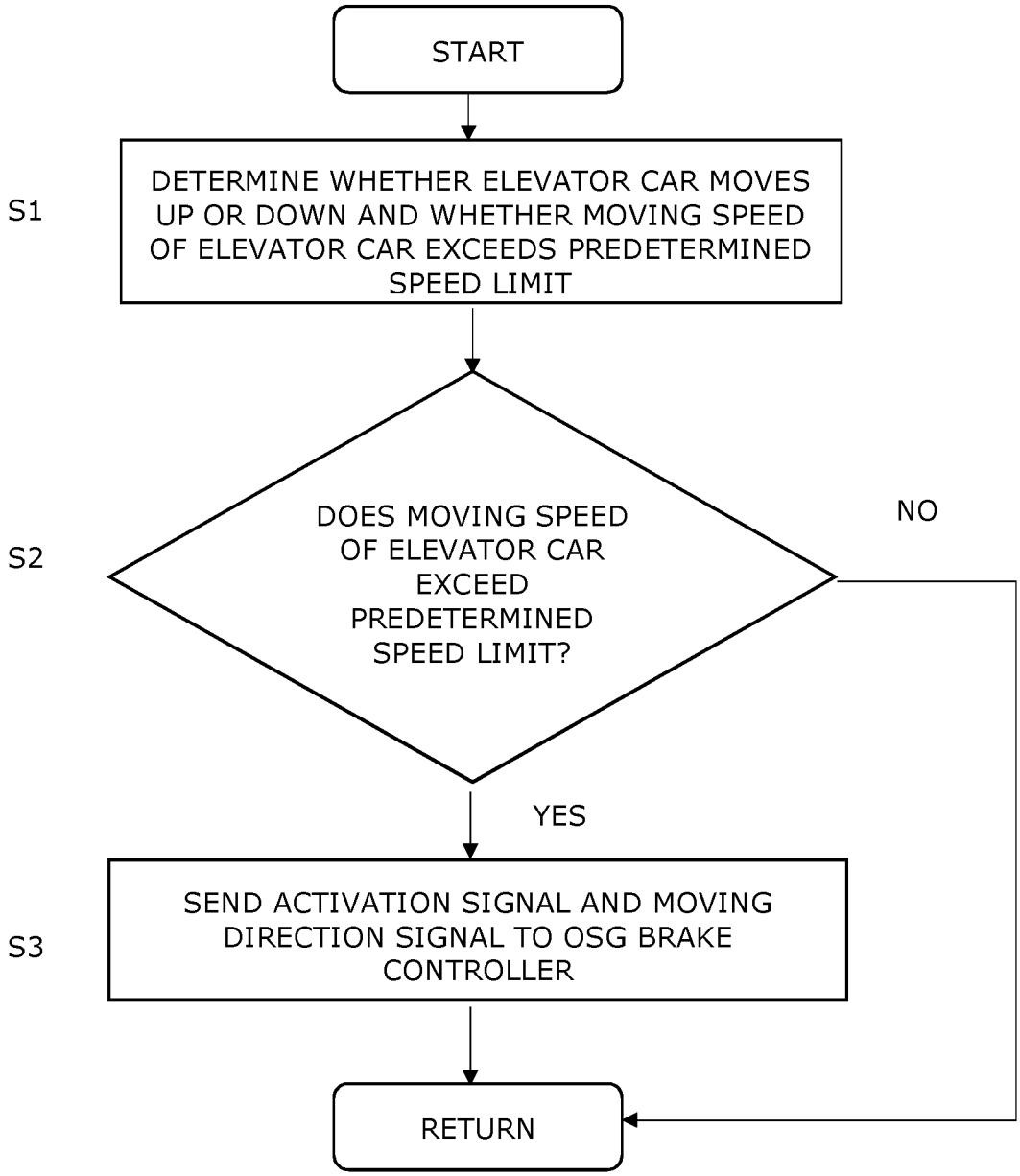
FIG. 6 shows a flow chart of a control of the elevator car controller shown in FIG. 5.

FIG. 6 shows a flow chart of a control procedure carried out by the elevator controller 23 of FIG. 5. According to step S1, the elevator car controller 23 determines whether the elevator car 6 is moving up or down and whether the moving speed of the elevator car exceeds a predetermined speed limit. In step S2, if the moving speed of the elevator car exceeds the predetermined speed limit, the control proceeds to step S3 (yes in S2) and sends an activation signal and a moving direction signal to the OSG system controller 30. The moving direction signal indicates whether the elevator car 6 is moving up or down.

The above mentioned predetermined speed limit can be 0.5 m/s, for example, which corresponds to an inspection drive of the elevator. In this case, the activation of the governor brake or the blocking of the synchronization linkage of the safety gear is disabled during inspection drive. However, the invention is not limited to that the moving speed of the elevator car 6 exceeds a predetermined speed limit and the activation of the governor brake or the blocking of the synchronization linkage of the safety gear can also be done without referring to a speed limit. According to a first modification of the first embodiment, the speed limit can be 0.0 m/s. In this case, an activation signal is sent to the OSG brake controller in step S3 of FIG. 6 when the elevator car is moving at all, i.e. also during the inspection drive.

Figure 7:
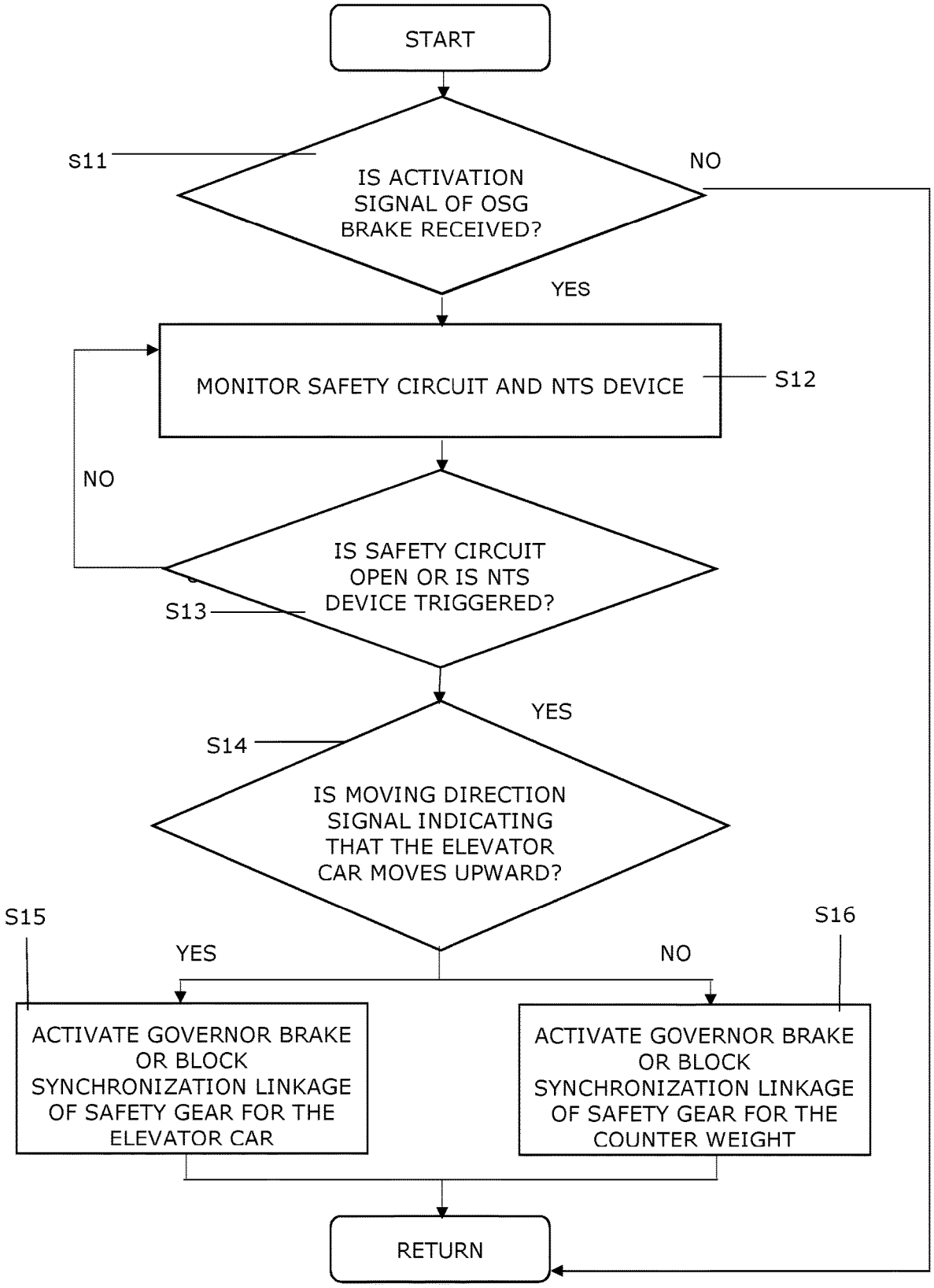
FIG. 7 shows a flow chart of the governor brake controller and the elevator car controller monitoring device shown in FIG. 5.

Meanwhile, as is shown in FIG. 7, the OSG brake controller 30 shown in FIG. 5 monitors in step S11 whether the activation signal is received from the elevator controller 23. According to the above mentioned first modification, the activation signal is received if the elevator car moves at all, i.e. also during the inspection drive. If the activation signal is received (yes in step S11), the elevator controller monitoring device 32 shown in FIG. 5 is activated in step S12. In other words, the elevator controller monitoring device 32 monitors whether the safety circuit 21 of the elevator system 1 is open, i.e. whether one of the safety switches of the safety circuit 21 is open such that a quick stop will be carried out by the elevator controller 23. Furthermore, the elevator controller monitoring device 32 monitors whether the NTS-device is triggered such that a quick stop will be carried out by the elevator controller 23. In both cases, the quick stop will result in a strong deceleration of the elevator car 6.

If the elevator controller monitoring device 32 determines that the safety circuit 21 is open or the NTS device is activated or triggered (yes in step S13), the control proceeds to step S14. Otherwise, the control turns back to step S12.

In step S14, it is determined whether the moving direction signal indicates that the elevator car 6 moves upward. If this is the case (yes in Step S14), the control proceeds to step S15 in which the governor brake 5 of the OSG system 2 for the elevator car 6 is activated by the governor brake controller 31. In a complementary or alternative embodiment, the synchronization linkage 14 of the OSG system 2 for the elevator car 6 is blocked by activating the respective blocking device 15 by the governor brake controller 31 or a separate blocking device controller (not shown).

On the other hand, if the moving direction signal indicates that the elevator car 6 moves downward (no in step S14), the control proceeds to step S16 in which the governor brake 55 of the OSG system 52 for the counterweight 7 is activated by the governor brake controller 31. Complementary or alternatively, the synchronization linkage 64 of the OSG system 52 for the counterweight 7 is blocked by activating the respective blocking device 15 by the governor brake controller 31 or a separate blocking device controller (not shown).

By means of this control, the OSG brake controller 30 is informed by the elevator controller 23 about the upcoming event of a quick stop of the elevator car 6 when the speed of the elevator car 6 is high enough that the quick stop will result in a certain degree of deceleration of the elevator car 6.

Furthermore, when the elevator car 6 moves upward and is then decelerated, the inertia of the governor rope 3 acts on the synchronization linkage 14 of the elevator car 6 such that there is a risk of unwanted tripping of the safety gear 4 of the OSG system for the elevator car 6. Hence, in this case, when quick stop is performed and thus, the deceleration of the elevator car 6 exceeds a certain deceleration, the governor rope 3 of the OSG system for the elevator car 6 is braked by activating the governor brake 5 of the OSG system for the elevator car 6. Hence, the inertia of the governor rope 3 is dissipated such that the synchronization linkage 14 of the OSG system for the elevator car 6 does not unwantedly engage the safety gear 4. Complementary or alternatively, the blocking device 15 is activated such that the operation of the synchronization linkage 14 of the OSG system for the elevator car 6 is blocked such that the safety gear 4 is not engaged even if the inertia of the governor rope 3 would be high enough for operating the synchronization linkage 14.

By contrast, when the elevator car 6 moves downward and is then decelerated, the inertia of the governor rope 53 acts on the synchronization linkage 64 of the counterweight 7 such that there is a risk of unwanted tripping of the safety gear 54 of the OSG system 52 for the counterweight 7. Hence, in this case, when the quick stop is performed and thus, the deceleration of the elevator car 6 exceeds a certain deceleration, the governor rope 53 of the OSG system 52 for the counterweight 7 is braked by activating the governor brake 55 of the OSG system 52 for the counterweight 7.

Hence, the inertia of the governor rope 53 is dissipated such that the synchronization linkage 64 of the OSG system 52 for the counterweight 7 does not unwantedly engage the safety gear 54.

Complementary or alternatively, the blocking device 15 is activated such that the operation of the synchronization linkage 64 of the OSG system 52 for the counterweight 7 is blocked such that the safety gear 54 is not engaged even if the inertia of the governor rope 53 would be high enough for operating the synchronization linkage 64.

In the following, the control schemes according to a second embodiment will be described with respect to FIGS. 8 and 9.

In the first embodiment, the claimed unwanted safety gear tripping avoiding controller is implemented in both the elevator controller 23 and the OSG system controller 30 in a shared manner. This is, the OSG brake controller 30 uses information regarding the elevator speed from the elevator controller 23 and monitors the safety circuit 21 and the NTS device 22 of the elevator controller 23 for concluding that the quick stop is performed, resulting in a certain degree of deceleration of the elevator car 6, so as to take a measure against unwanted tripping of the safety gear.

By contrast, in the second embodiment, the governor brake 5 and/or the blocking device 15 are fully controlled by the elevator controller 203. Hence, as is shown in FIG. 8, elevator system 1 comprises a governor brake controller 204 in addition to the safety circuit 201, the NTS-device 202 and the elevator controller 203. Unlike the first embodiment, there is no separate OSG brake controller 30 with elevator controller monitoring device 32 in the second embodiment.

Figure 8:
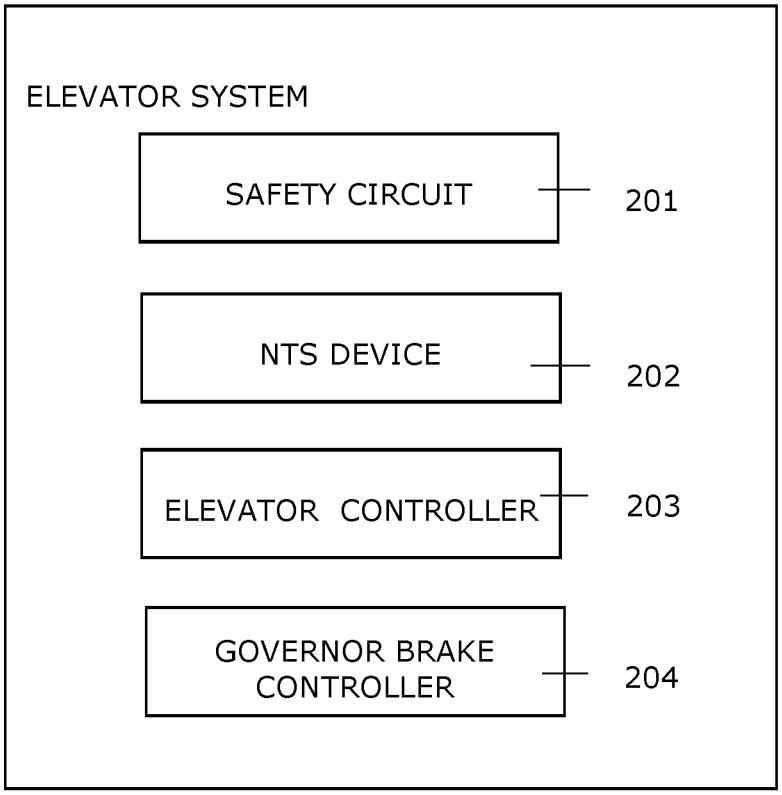
FIG. 8 shows a controller scheme of an elevator system according to a second embodiment.
Figure 9:
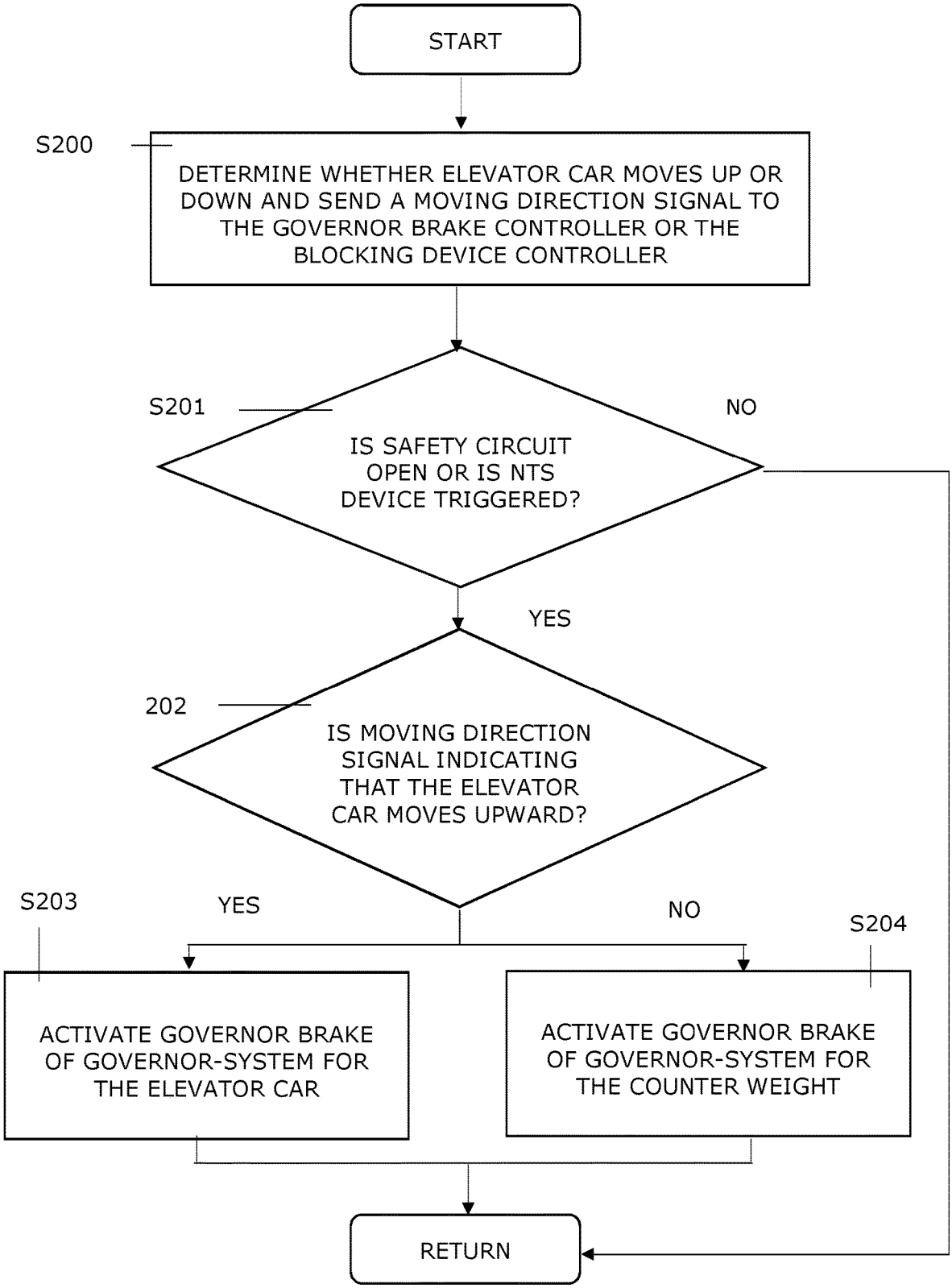
FIG. 9 shows a flow chart of the elevator system shown in FIG. 8.

FIG. 9 shows a flow chart of a control procedure carried out by the elevator controller 203 of FIG. 8. According to step S200, the elevator controller 203 determines whether the elevator car 6 is moving up or down and sends a moving direction signal to the governor brake controller 204 to indicate whether the elevator car 6 is moving up or down.

Furthermore, the elevator car controller 203 monitors whether the safety circuit 201 of the elevator system 1 is open, i.e. whether one of the safety switches of the safety circuit 201 is open such that a quick stop will be carried out by the elevator controller 203. Furthermore, the elevator controller 203 monitors whether the NTS device 202 is triggered such that a quick stop will be carried out. In both cases, the quick stop will result in a strong deceleration of the elevator car 6.

If the elevator controller 203 determines that the safety circuit 21 is open or the NTS device is activated (yes in step S201), the control proceeds to step 202. Otherwise, the control procedure returns to start (see no in step S201).

In step S202, it is determined whether the moving direction signal indicates that the elevator car 6 moves upward. If this is the case (yes in Step S202), the control proceeds to step S203 in which the governor brake 4 of the OSG system 2 for the elevator car 6 is activated by the governor brake controller 204. In a complementary or alternative embodiment, the synchronization linkage 14 of the OSG system 2 for the elevator car 6 is blocked by activating the respective blocking device 15 by a blocking device controller (not shown).

On the other hand, if the moving direction signal indicates that the elevator car 6 moves downward (no in step S203), the control proceeds to step S204 in which the governor brake 55 of the OSG system 52 for the counterweight 7 is activated by the governor brake controller 204. Complementarily or alternatively, the synchronization linkage 64 of the OSG system 52 for the counterweight 7 is blocked by activating the respective blocking device 15 by a blocking device controller (not shown).

By means of this control, the elevator controller 203 determines whether there is the event of a quick stop of the elevator car 6 which might result in a certain degree of deceleration of the elevator car 6. Furthermore, when the elevator car 6 moves upward and is then decelerated, the inertia of the governor rope 3 acts on the synchronization linkage of the elevator car 6 such that there is a risk of unwanted tripping of the safety gear 4 of the OSG system for the elevator car 6. Hence, in this case, when a quick stop is performed and thus, the deceleration of the elevator car 6 exceeds an allowable deceleration, the governor rope 3 of the OSG system for the elevator car 6 is braked by activating the governor brake 5 of the OSG system for the elevator car 6. Hence, the inertia of the governor rope 3 is dissipated such that the synchronization linkage 14 of the OSG system for the elevator car 6 does not unwantedly engage the safety gear 4. Complementarily or alternatively, the blocking device 15 is activated such that the operation of the synchronization linkage 14 is blocked such that the safety gear is not engaged even if the inertia of the governor rope 3 would be high enough for operating the synchronization linkage 14.

By contrast, when the elevator car 6 moves downward and is then decelerated, the inertia of the governor rope 53 acts on the synchronization linkage 64 of the counterweight 7 such that there is a risk of unwanted tripping of the safety gear 54 of the OSG system 52 for the counterweight 7. Hence, in this case, when the quick stop is performed and thus, the deceleration of the elevator car 6 exceeds a certain deceleration due to the quick stop, the governor rope 53 of the OSG system 52 for the counterweight 7 is braked by activating the governor brake 55 of the OSG system 52 for the counterweight 7. Hence, the inertia of the governor rope 53 is dissipated such that the synchronization linkage 64 of the OSG system for the counterweight 7 does not unwantedly engage the safety gear 54. Complementarily or alternatively, the blocking device 15 is activated such that the operation of the synchronization linkage 64 is blocked such that the safety gear 54 is not engaged even if the inertia of the governor rope 53 would be high enough for operating the synchronization linkage 64

As in the first embodiment, the elevator controller 203 can additionally determine in step S200 whether the elevator speed exceeds a predetermined speed limit. In this modification, the step S201 will only be carried out if the actual elevator speed exceeds the predetermined speed limit. Otherwise, the control can be terminated. Hence, the governor brake 5 and/or the blocking device 15 will only be activated if the elevator speed is above the predetermined speed limit upon the event of the quick stop. Thus, the governor brake 5 or the blocking device 15 will only be activated if the deceleration during the quick stop is large enough for resulting in a correspondingly large inertia force of the governor rope 3 such that there is a risk of unwantedly tripping the safety gear 4. Hence, if there is no risk of unwanted safety gear tripping because the elevator speed is below the predetermined speed limit, the governor brake 5 or the blocking device 15 does not need to be operated.

The above mentioned predetermined speed limit can be 0.5 m/s, for example.

In the following, the control schemes according to the third embodiment will be described with respect to FIGS. 10 and 11.

In contrast to the first and second embodiment, in the third embodiment, the governor brake 5 and/or the blocking device 15 are fully controlled by the OSG brake controller 300. Hence, as is shown in FIG. 10, the OSG brake controller 300 comprises an elevator movement detecting device 301 and a governor brake controller 302.

The elevator movement detecting device 301 can be a speed sensor, an accelerometer or a gyroscope and is suitable for deriving or detecting the elevator speed, the moving direction of the elevator and the acceleration and deceleration of the elevator car 6 and the counterweight 7 and thus of the governor ropes 3, 53.

Figure 10:
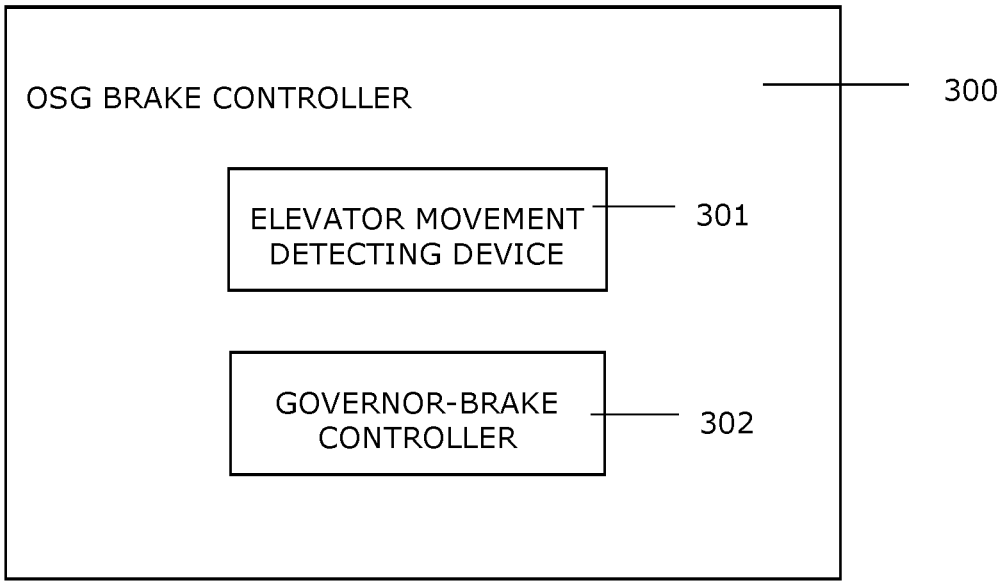
FIG. 10 shows a controller scheme of an OSG system according to a third embodiment.
Figure 11:
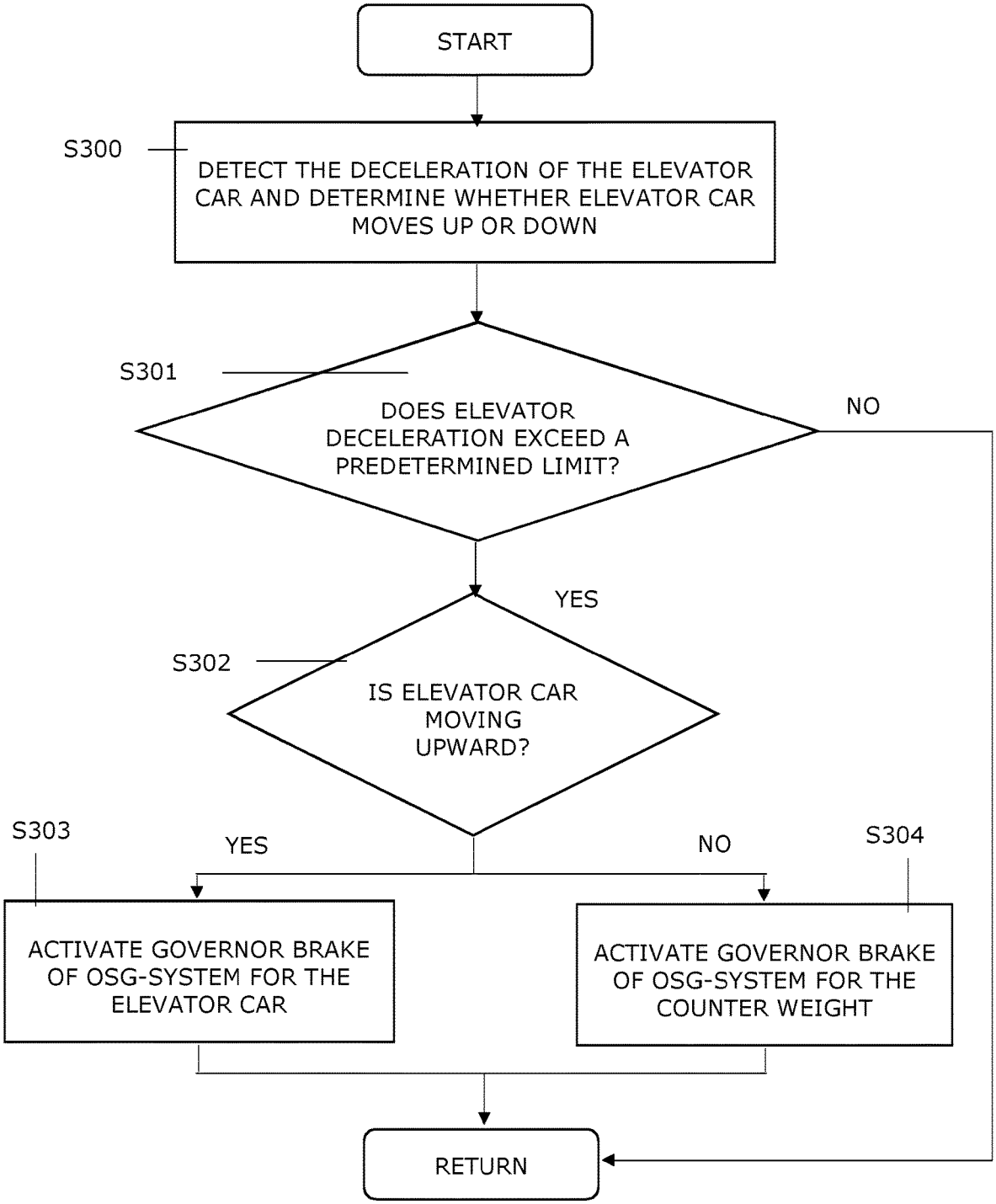
FIG. 11 shows a flow chart of the OSG system shown in FIG. 10.
Figure 12A:
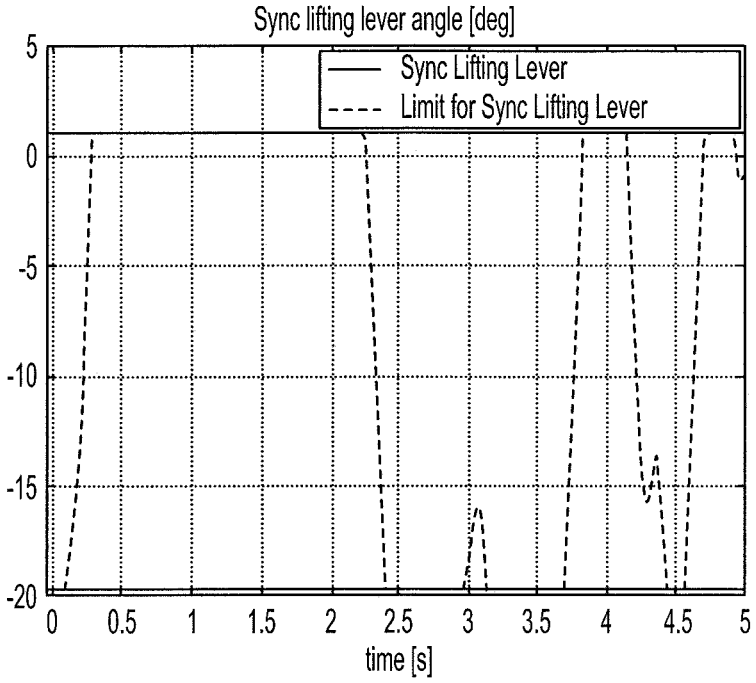
FIG. 12A shows synchronization lever angle at bottom of the shaft without governor brake and FIG. 12B shows synchronization lever angle at bottom of the shaft with governor brake.
Figure 12B:
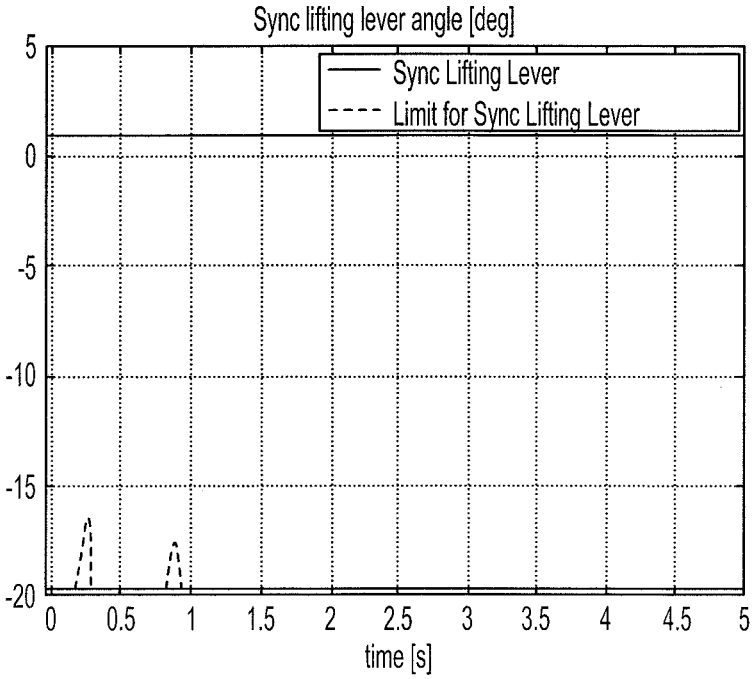

FIG. 11 shows a flow chart carried out by the OSG brake controller 300 of FIG. 10. According to step S300, the elevator movement detecting device 301 determines whether the elevator car 6 is moving up or down and detects the deceleration of the elevator car 6.

In step S301, it is determined whether the deceleration of the elevator car 6 exceeds a predetermined deceleration limit. If the detected deceleration exceeds the predetermined deceleration limit, the control proceeds to step S302. Otherwise, the control is terminated.

In step S302, it is determined whether the elevator car 6 moves upward. If this is the case (yes in Step S302), the control proceeds to step S303 in which the governor brake 5 of the OSG system 2 for the elevator car 6 is activated by the governor brake controller 302. Complementarily or alternatively, the synchronization linkage 14 of the OSG system 2 for the elevator car 6 is blocked by activating the respective blocking device 15 by a blocking device controller (not shown).

On the other hand, if it is determined that the elevator car 6 moves downward (no in step S302), the control proceeds to step S304 in which the governor brake 55 of the OSG system 52 for the counterweight 7 is activated by the governor brake controller 302. Complementarily or alternatively, the synchronization linkage 64 of the OSG system 52 for the counterweight 7 is blocked by activating the respective blocking device 15 by a blocking device controller (not shown).

By means of this control, the elevator movement detection device 301 determines whether the deceleration of the elevator car 6 is above the predetermined deceleration limit. Furthermore, when the elevator car moves upward and is then decelerated, the inertia of the governor rope 3 acts on the synchronization linkage 14 of the elevator car 6 such that there is a risk of unwanted tripping of the safety gear of the OSG system for the elevator car 6. Hence, in this case, when the deceleration of the elevator car 6 exceeds a predetermined deceleration limit due to the quick stop, the governor rope 3 of the OSG system 2 for the elevator car 6 is braked by activating the governor brake 5 of the OSG system for the elevator car 6. Hence, the inertia of the governor rope 3 is dissipated such that the synchronization linkage 14 of the OSG system for the elevator car 6 does not unwantedly engage the safety gear 4. Complementarily or alternatively, the blocking device 15 is activated such that the operation of the synchronization linkage 14 is blocked such that the safety gear 4 is not engaged even if the inertia of the governor rope 3 would be high enough for operating the synchronization linkage 14.

By contrast, when the elevator car 6 moves downward and is then decelerated, the inertia of the governor rope 3 acts on the synchronization linkage 64 of the counterweight 7 such that there is a risk of unwanted tripping of the safety gear 54 of the OSG system 52 for the counterweight 7. Hence, in this case, when the deceleration of the elevator car 6 exceeds a predetermined deceleration limit due to the quick stop, the governor rope 53 of the OSG system 52 for the counterweight 7 is braked by activating the governor brake 55 of the OSG system 52 for the counterweight 7. Hence, the inertia of the governor rope 53 is dissipated such that the synchronization linkage 64 of the OSG system 52 for counterweight 7 does not unwantedly engage the safety gear 54. Complementarily or alternatively, the blocking device 15 is activated such that the operation of the synchronization linkage 64 is blocked such that the safety gear 4 is not engaged even if the inertia of the governor rope 53 would be high enough for operating the synchronization linkage 64.

The system according to the third embodiment is fully independent from the elevator control system. For example, the control of the third embodiment can be implemented directly into the governor brake 5, 55 or into the blocking device 15 of the synchronization linkage 14, 64.

In the above embodiments, the elevator system has a safety circuit and an NTS-device. However, according to a modification, the elevator system has only one of the safety circuit and the NTS device.

In the above embodiments, the moving direction of the elevator car is determined (see S1 in FIG. 6 and S14 in FIGS. 7, S200 and S202 in FIG. 9, and S300 and S302 in FIG. 11), and the governor brake is activated for the elevator car or for the counter weight depending on the moving direction of the elevator car, or the synchronization linkage of the safety gear is blocked for the elevator car or for the counter weight depending on the moving direction of the elevator car. However, according to modifications of the embodiments, the steps of determining the moving directions can be omitted and the governor brakes for both of the elevator car and the counterweight can be activated, or the synchronization linkages of the safety gears for both of the elevator car and the counterweight can be blocked if the safety circuit is open, the NTS-device is triggered or the elevator deceleration exceeds a predetermined limit.

DESCRIPTION OF EXAMPLES

According to the above embodiments, one way to absorb the governor rope kinetic energy is to stop OSG pulley and/or tension weight diverting pulley by a separate brake and to decelerate the governor rope by rope traction. Therein, the pulley traction capability is depending on rope forces which can be obtained as follows.

Traction at Governor Pulley $$\begin{cases} F_1 + F_2 = g(m_{TW} + 2Hm_r) \\ \dfrac{F_1}{F_2} = e^{f\mu\alpha} \end{cases}$$

By solving these formulas, the traction force and energy during deceleration is obtained:

$$\Delta F_{OSG} = g(m_{TW} + 2Hm_r) - 2g\frac{m_{TW} + 2Hm_r}{e^{f\mu\alpha} + 1}$$

$$W_{OSG} = \Delta F_{OSG} s$$

Same equations apply for tension weight pulley, but here, the mass of the governor rope is zero.

The total energy absorbed is then $$W_{tot} = W_{OSG} W_{div}$$

Below is given an example calculation of pulley traction absorption capabilities at two different travel height.

TABLE 1

| OSG and tension weight pulley traction capability | | |
|---|---|---|
| Travel H [m] | 400 | 750 |
| Governor rope kinetic energy at 10 m/s [kJ] | 12.8 | 24.8 |
| OSG traction force | 1242 | 1538 |
| Diverting pulley traction force | 884 | 884 |
| Total traction force | 2126 | 2421 |
| Energy from OSG traction [kJ] | 14.9 | 18.5 |
| energy from div pulley traction [kJ] | 10.6 | 10.6 |
| Total [kJ] | 25.5 | 29.1 |

A quick stop simulation for the overspeed governor system 2 including the synchronization linkage 14 was performed. The travel distance of the elevator car 6 was chosen to be 750 m and the rated speed was 10 m/s. During the quick stop, a linear deceleration of 5 $m/s^2$ is assumed. The simulation was run at three different locations in the shaft, namely at the bottom, the middle and the top of the shaft. The simulations were also run with and without the additional governor rope brakes 5. The braking forces were chosen as calculated with the above formulas and given in table 1. Hence, for OSG traction force 1538N was used and for diverting pulley at tension weight 884N was used. The synchronization linkage 14 was dimensioned such that ~1100N force from OSG rope is enough to activate the safety gears.

Figure 13A:
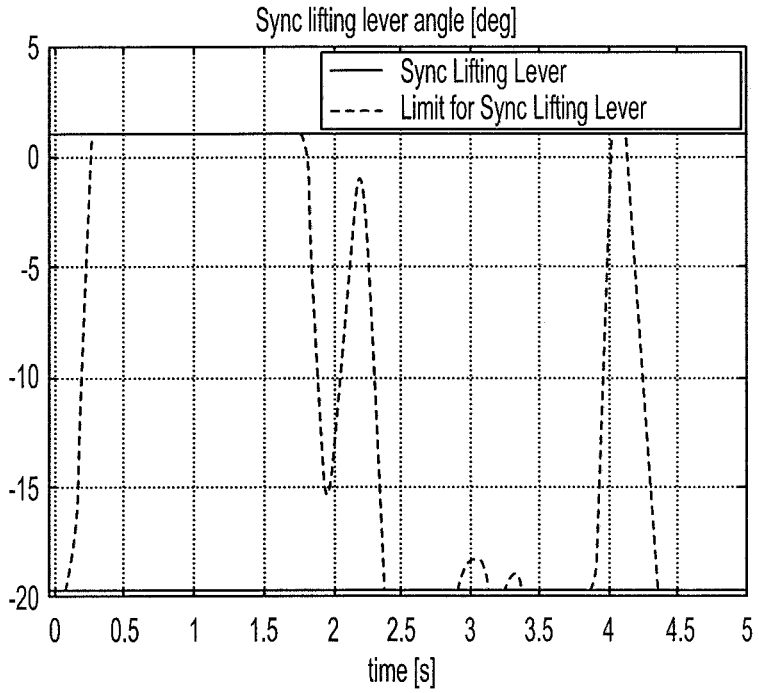
FIG. 13A shows synchronization lever angle at middle of the shaft without governor brake and FIG. 13B shows synchronization lever angle at middle of the shaft with governor brake.
Figure 13B:
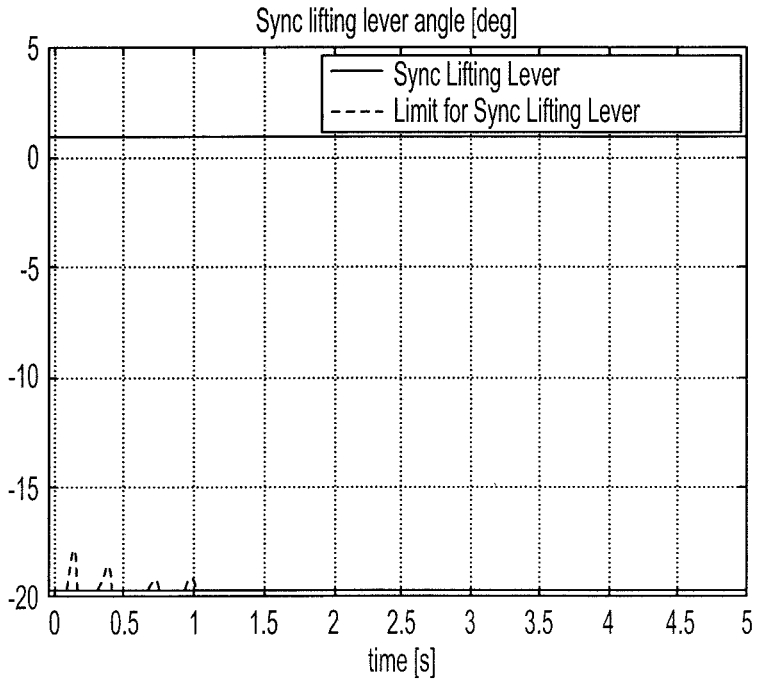
Figure 14A:
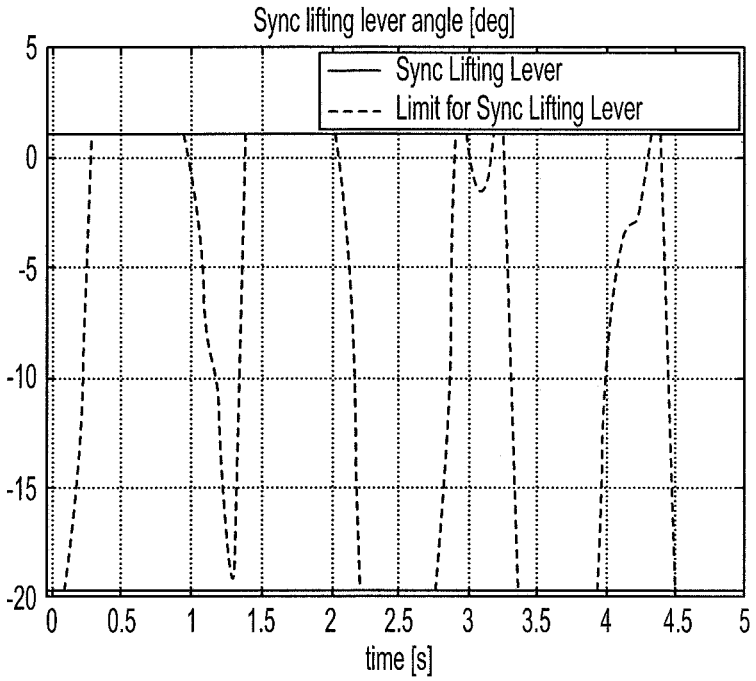
FIG. 14A shows synchronization lever angle at top of the shaft without governor brake and FIG. 14B shows synchronization lever angle at top of the shaft with governor brake.
Figure 14B:
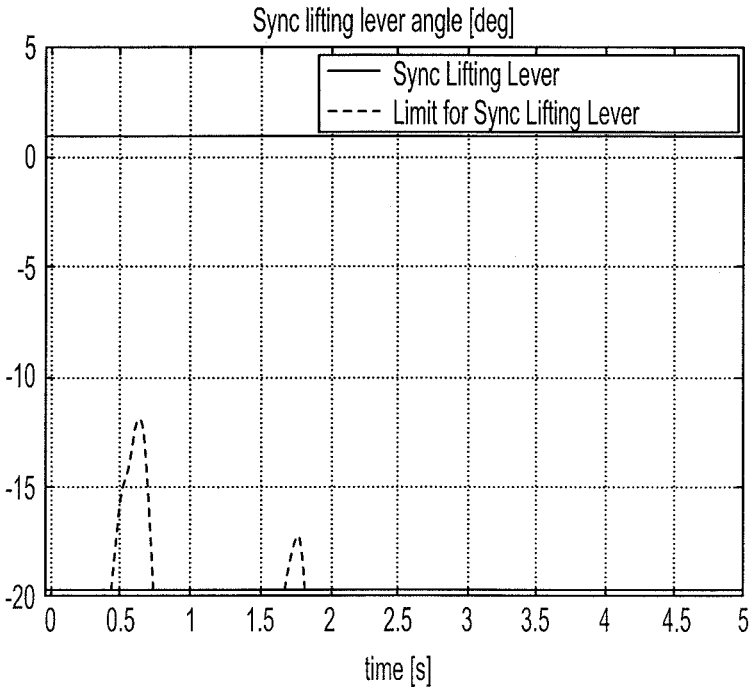
Figure 15:
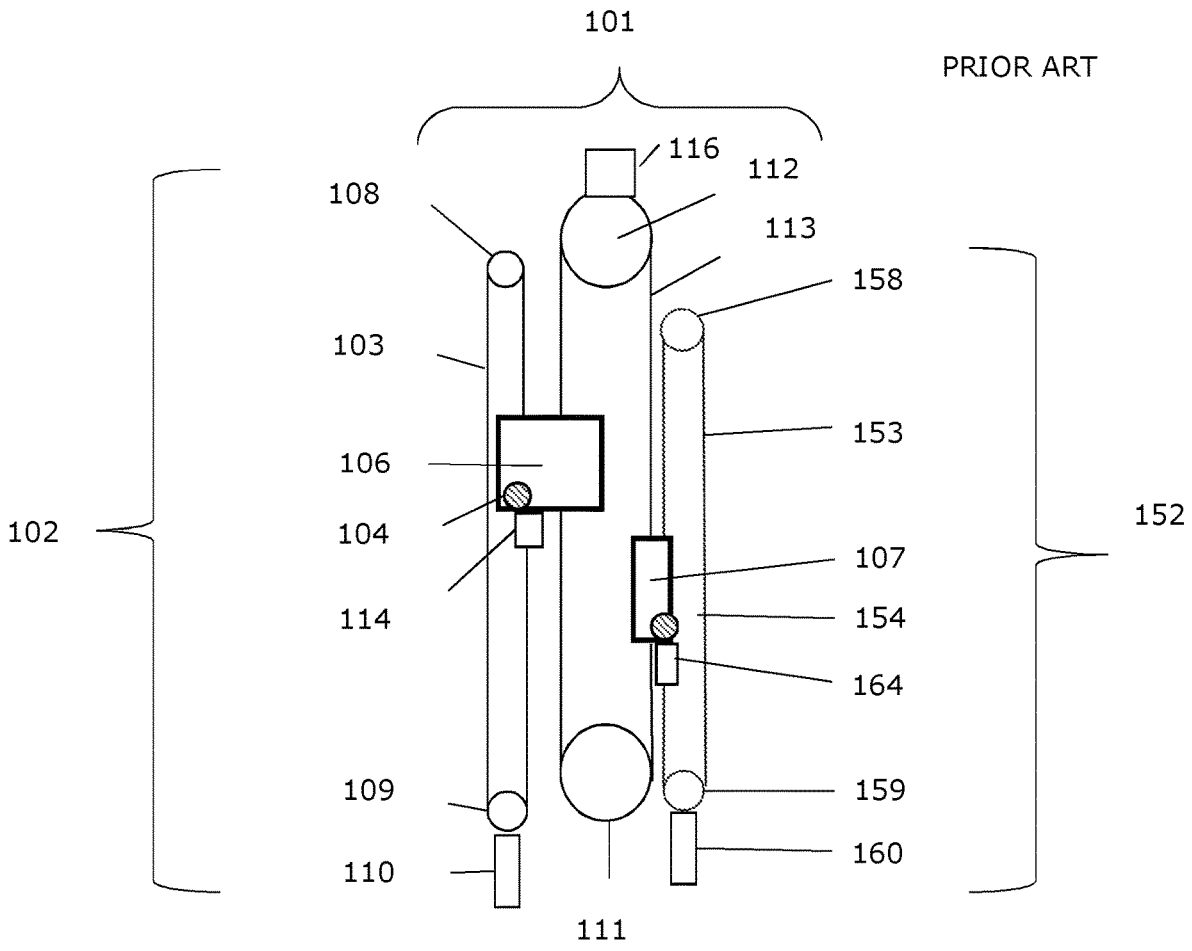
FIG. 15 shows an elevator system according to the background art.

In the FIGS. 13 to 15 is shown the synchronization lever angle as a function of time and quick stop for elevator is activated at t=0 s. The lower horizontal line represents the lower limit of the synchronization lever (normal position) and the upper horizontal line is the angle where the safety gear is assumed to be activated. In the simulation the braking action of the safety gear is not taken into account, i.e. the contact between the safety gear wedges/brake pads and the elevator guide rails is not included.

For all synchronization locations in the shaft, the unintentional safety gear tripping is possible, when the OSG system does not include the additional governor brakes. In all of the above mentioned shaft locations, the synchronization lever angle reaches the upper horizontal line almost immediately after the quick stop is performed.

When additional governor brakes are activated, the unwanted tripping of the safety gear is not possible, as the synchronization lever angle does not reach the upper horizontal line.

The invention claimed is:

1. A method for avoiding unwanted safety gear tripping in an overspeed governor system of an elevator system, the elevator system comprising an elevator car acting as a moving mass, wherein the overspeed governor system is provided for the elevator car, the overspeed governor system having a governor rope connected to the moving mass of the elevator system, a machinery brake for decelerating the moving mass so as to perform a quick stop of the moving mass, a safety gear mounted to the moving mass, a synchronization linkage for tripping the safety gear and a synchronization linkage blocking device for blocking the synchronization linkage and/or a governor brake for braking the governor rope, the method comprising the steps of:

determining whether a quick stop of the moving mass is performed; and activating the governor brake or the synchronization linkage blocking device when the quick stop of the moving mass is performed, said method further comprising the steps of:

determining whether the elevator car moves up or down; and when the elevator car moves up, activating the governor brake and/or the synchronization linkage blocking device of the overspeed governor system for the elevator car.

2. The method according claim 1, wherein the elevator system comprises a safety circuit configured to indicate that the safety of the elevator system is jeopardized, wherein the method further comprises the steps of:

determining whether the safety circuit indicates jeopardized safety; and concluding that the quick stop of the moving mass is performed if said jeopardized safety indication is present.

3. The method according to claim 1, wherein the elevator system comprises a controller for controlling stopping of the moving mass at a terminal floor and a normal terminal slowdown device configured to output a normal terminal slowdown signal if stopping of the moving mass at the terminal floor by control of the controller is jeopardized, wherein the method further comprises the steps of:

determining whether the normal terminal slowdown signal is output; and concluding that the quick stop of the moving mass is performed if the normal terminal slowdown signal is output.

4. The method according to claim 1, wherein the elevator system further comprises a counterweight acting as another moving mass, wherein another overspeed governor system is provided for the counterweight, said method further comprising the step of:

when the elevator car moves down, activating the governor brake and/or the synchronization linkage blocking device of the overspeed governor system for the counterweight.

5. An unwanted safety gear tripping avoiding controller for avoiding unwanted safety gear tripping in an elevator system, the unwanted safety gear tripping avoiding controller being adapted to perform the steps of the method according to claim 1.

6. A governor brake for braking a governor rope so as to avoid unwanted safety gear tripping in an elevator system, wherein the elevator system comprises an overspeed governor system having at least a governor rope connected to a moving mass of the elevator system, a machinery brake for decelerating the moving mass so as to perform a quick stop of the moving mass, and a safety gear mounted to the moving mass, the governor brake further comprising the unwanted safety gear tripping avoiding controller according to claim 5.

7. The governor brake according to claim 6, wherein the unwanted safety gear tripping avoiding controller is adapted to monitor the safety circuit and/or the normal terminal slowdown device of the elevator system so as to conclude about whether the quick stop of the moving mass is performed.

8. The governor brake according to claim 6, wherein the governor brake further comprises:

an elevator movement detecting device for detecting the deceleration of the governor rope, wherein the unwanted safety gear tripping avoiding controller is adapted to monitor the elevator movement detecting device so as to conclude about whether the quick stop of the moving mass is performed.

9. The governor brake according claim 8, wherein the elevator movement detecting device is a speed sensor which is adapted to measure the speed of the governor rope, or an accelerometer or a gyroscope adapted to measure the deceleration of the governor rope.

10. An elevator system comprising: an overspeed governor system having at least a governor rope connected to a moving mass of the elevator system;

a machinery brake for decelerating the moving mass so as to perform a quick stop of the moving mass;

a safety gear mounted to the moving mass;

a synchronization linkage for tripping the safety gear;

a synchronization linkage blocking device for blocking the synchronization linkage and/or a governor brake for braking the governor rope; and the unwanted safety gear tripping avoiding controller according to claim 5.

11. The elevator system according to claim 10, wherein the elevator system further comprises an elevator controller and the unwanted safety gear tripping avoiding controller is implemented in the elevator controller.

12. The elevator system according to claim 10, wherein the overspeed governor system further comprises an OSG brake controller and the unwanted safety gear tripping avoiding controller is implemented in the OSG brake controller.

13. The elevator system according to claim 10, wherein the elevator system comprises an elevator car and a counterweight each acting as a moving mass, wherein one overspeed governor system is provided for the elevator car and another overspeed governor system is provided for the counterweight, wherein the elevator system further comprises an elevator controller and the governor systems further comprise an OSG brake controller constituting the unwanted safety gear tripping avoiding controller, wherein the elevator controller is adapted to determine whether the elevator car moves up or down and to determine whether the moving speed of the elevator car exceeds a predetermined speed limit, wherein the elevator controller is adapted to send an activation signal and a moving direction signal to the OSG brake controller if the moving speed of the elevator car exceeds the predetermined speed limit, wherein the OSG brake controller is adapted to, upon receipt of the activation signal and the moving direction signal, determine whether the quick stop of the moving mass is performed, and when the quick stop of the moving mass is performed, to activate the governor brake and/or the synchronization linkage blocking device of the overspeed governor system for the elevator car, if the moving direction signal indicates that the elevator car moves up, and to activate the governor brake or the synchronization linkage blocking device of the overspeed governor system for the counterweight if the moving direction signal indicates that the elevator car moves down.

14. The elevator system according to claim 10, wherein the overspeed governor system further comprises an overspeed governor pulley and a tension weight pulley, and wherein the governor brake is a brake device acting on the overspeed governor pulley, a brake device acting on the governor rope or a brake device acting on tension weight pulley.

15. A synchronization linkage blocking device for blocking a synchronization linkage as to avoid unwanted safety gear tripping in an elevator system, wherein the elevator system comprises an overspeed governor system having at least a governor rope connected to a moving mass of the elevator system via the synchronization linkage, a machinery brake for decelerating the moving mass so as to perform a quick stop of the moving mass, and a safety gear mounted to the moving mass, the synchronization linkage blocking device further comprising the unwanted safety gear tripping avoiding controller according to claim 5.

16. The method according to claim 2, wherein the elevator system further comprises a counterweight acting as another moving mass, wherein another overspeed governor system is provided for the counterweight, said method further comprising the step of:

when the elevator car moves down, activating the governor brake and/or the synchronization linkage blocking device of the overspeed governor system for the counterweight.

17. The method according to claim 3, wherein the elevator system further comprises a counterweight acting as another moving mass, wherein another overspeed governor system is provided for the counterweight, said method further comprising the step of:

when the elevator car moves down, activating the governor brake and/or the synchronization linkage blocking device of the overspeed governor system for the counterweight.

18. An unwanted safety gear tripping avoiding controller for avoiding unwanted safety gear tripping in an elevator system, the unwanted safety gear tripping avoiding controller being adapted to perform the steps of the method according to claim 2.

19. An unwanted safety gear tripping avoiding controller for avoiding unwanted safety gear tripping in an elevator system, the unwanted safety gear tripping avoiding controller being adapted to perform the steps of the method according to claim 3.

20. An unwanted safety gear tripping avoiding controller for avoiding unwanted safety gear tripping in an elevator system, the unwanted safety gear tripping avoiding controller being adapted to perform the steps of the method according to claim 4.

* * * * *